US011616324B2

(12) United States Patent
Storione et al.

(10) Patent No.: US 11,616,324 B2
(45) Date of Patent: Mar. 28, 2023

(54) MULTIPOLAR CONNECTOR

(71) Applicant: FISCHER CONNECTORS HOLDING S.A., Saint-Prex (CH)

(72) Inventors: Savino Storione, Saint-Prex (CH); Nicolas Convert, Saint-Prex (CH); Jean-Marie Buchilly, Saint-Prex (CH)

(73) Assignee: Conextivity Group SA, St-Prex (CH)

( * ) Notice: Subject to any disclaimer, the term of this patent is extended or adjusted under 35 U.S.C. 154(b) by 414 days.

(21) Appl. No.: 17/045,386

(22) PCT Filed: Apr. 5, 2019

(86) PCT No.: PCT/IB2019/052822
§ 371 (c)(1),
(2) Date: Oct. 5, 2020

(87) PCT Pub. No.: WO2019/193567
PCT Pub. Date: Oct. 10, 2019

(65) Prior Publication Data

US 2021/0159640 A1 May 27, 2021

(30) Foreign Application Priority Data

Apr. 6, 2018 (WO) ..... PCT/IB2018/052391

(51) Int. Cl.
*H01R 13/635* (2006.01)
*H01R 13/627* (2006.01)
*H01R 13/52* (2006.01)

(52) U.S. Cl.
CPC ..... *H01R 13/6276* (2013.01); *H01R 13/5219* (2013.01); *H01R 13/635* (2013.01)

(58) Field of Classification Search
CPC ..... H01R 13/6276; H01R 13/5219; H01R 13/635
See application file for complete search history.

(56) References Cited

U.S. PATENT DOCUMENTS 2,761,111 A * 8/1956 Klostermann ..... H01R 13/633 439/271
2,824,290 A 2/1958 Archer et al.
2,892,991 A 6/1959 Beebee et al.
3,112,975 A 12/1963 Hamel
3,237,147 A 2/1966 Etal
(Continued)

FOREIGN PATENT DOCUMENTS

CN 102299438 A 12/2011
CN 104170184 11/2014
(Continued)

OTHER PUBLICATIONS

U.S. Appl. No. 17/045,385, filed Oct. 5, 2020.
(Continued)

*Primary Examiner* — Tho D Ta
(74) *Attorney, Agent, or Firm* — Nixon & Vanderhye P.C.

(57) ABSTRACT

A connector comprising a cylindrically shaped socket and a plug that may be connected to the socket in a removable manner, in which a plurality of contacts are disposed being mounted in a contact block. It comprises a ring with ogive shaped parts (21) assembled in a membrane (22), the ogive shaped parts and the membrane being covered by a locking spring (25).

14 Claims, 6 Drawing Sheets

(56) References Cited

U.S. PATENT DOCUMENTS

| | | | |
|---|---|---|---|
| 3,521,216 | A | 7/1970 | Tolegian |
| 4,601,528 | A | 7/1986 | Spier |
| 5,114,361 | A | 5/1992 | Houtteman |
| 5,413,508 | A | 5/1995 | Obara |
| 5,509,821 | A | 4/1996 | Small et al. |
| 5,554,042 | A | 9/1996 | Denninger |
| 5,704,792 | A | 1/1998 | Sobhani |
| 5,803,750 | A | 9/1998 | Purington et al. |
| 5,865,638 | A | 2/1999 | Trafton |
| 6,243,870 | B1 | 6/2001 | Graber |
| 6,331,117 | B1 | 12/2001 | Brundage |
| 6,395,985 | B1 | 5/2002 | Djeddah |
| 6,422,903 | B1 | 7/2002 | Fekonja et al. |
| 6,716,048 | B2 | 4/2004 | Collin et al. |
| 6,719,578 | B1 | 4/2004 | Klassen et al. |
| 6,895,261 | B1 | 5/2005 | Palamides |
| 6,945,805 | B1 | 9/2005 | Bollinger |
| 7,151,455 | B2 | 12/2006 | Lindsay et al. |
| 7,462,035 | B2 | 12/2008 | Lee et al. |
| 7,658,612 | B2 | 2/2010 | Lee et al. |
| 8,490,525 | B2 | 7/2013 | Wilson et al. |
| 8,496,494 | B2 | 7/2013 | Jordan |
| 8,961,191 | B2 | 2/2015 | Hanshew |
| 9,054,445 | B2 | 6/2015 | O'Sullivan et al. |
| 9,300,083 | B2 | 3/2016 | Bosscher et al. |
| 9,502,822 | B1 | 11/2016 | Huang |
| 9,847,609 | B2 | 12/2017 | Planard-Luong |
| 10,574,006 | B2 * | 2/2020 | Storione ..... H01R 35/04 |
| 11,374,351 | B2 * | 6/2022 | Storione ..... H01R 12/714 |
| 2001/0018277 | A1 | 8/2001 | Gerard et al. |
| 2001/0034152 | A1 | 10/2001 | Harris |
| 2002/0003931 | A1 | 1/2002 | Cairns et al. |
| 2002/0019177 | A1 | 2/2002 | Bartholomew |
| 2002/0168889 | A1 | 11/2002 | Adduci |
| 2003/0027435 | A1 | 2/2003 | Schneider et al. |
| 2003/0057698 | A1 | 3/2003 | Parrott et al. |
| 2003/0162431 | A1 | 8/2003 | Schmidt et al. |
| 2004/0038596 | A1 | 2/2004 | Bartholoma et al. |
| 2004/0166740 | A1 | 8/2004 | Jorgensen |
| 2005/0148241 | A1 | 7/2005 | Kohen |
| 2006/0051999 | A1 | 3/2006 | Allemann et al. |
| 2006/0110977 | A1 | 5/2006 | Matthews |
| 2006/0128169 | A1 | 6/2006 | Marmaropoulos et al. |
| 2007/0026695 | A1 | 2/2007 | Lee et al. |
| 2007/0085023 | A1 | 4/2007 | Debroche et al. |
| 2007/0087612 | A1 | 4/2007 | Tsujita |
| 2007/0244422 | A1 | 10/2007 | Chiodo |
| 2008/0214040 | A1 | 9/2008 | Holterhoff et al. |
| 2008/0233785 | A1 | 9/2008 | Yaworski et al. |
| 2009/0149086 | A1 | 6/2009 | Dahms |
| 2009/0280673 | A1 | 11/2009 | Kohen |
| 2009/0291579 | A1 | 11/2009 | Farole et al. |
| 2010/0075512 | A1 | 3/2010 | Lai |
| 2010/0100997 | A1 | 4/2010 | Lee et al. |
| 2010/0259293 | A1 | 10/2010 | Seifried |
| 2010/0291802 | A1 | 11/2010 | Sawai et al. |
| 2011/0021049 | A1 | 1/2011 | Ramasubramanian et al. |
| 2011/0098601 | A1 | 4/2011 | Huynh et al. |
| 2011/0269331 | A1 * | 11/2011 | Saber ..... H01R 13/629 439/372 |
| 2012/0028489 | A1 | 2/2012 | Gramsamer et al. |
| 2012/0052721 | A1 | 3/2012 | Watson |
| 2012/0089002 | A1 | 4/2012 | Mackie |
| 2012/0319398 | A1 | 12/2012 | Schweizer et al. |
| 2013/0102182 | A1 | 4/2013 | Ijima |
| 2013/0183866 | A1 | 7/2013 | Poulain et al. |
| 2013/0288501 | A1 | 10/2013 | Russell et al. |
| 2013/0344724 | A1 | 12/2013 | Song et al. |
| 2014/0073176 | A1 | 3/2014 | Plant et al. |
| 2014/0106589 | A1 | 4/2014 | Genta et al. |
| 2014/0130329 | A1 | 5/2014 | Changsrivong et al. |
| 2014/0134871 | A1 | 5/2014 | Jozwik et al. |
| 2014/0179148 | A1 | 6/2014 | Huang |
| 2014/0199896 | A1 | 7/2014 | Jordan |
| 2014/0273543 | A1 | 9/2014 | Hanshew |
| 2015/0093921 | A1 | 4/2015 | Lewin |
| 2015/0093931 | A1 | 4/2015 | Burrow et al. |
| 2015/0162674 | A1 | 6/2015 | Nishikawa et al. |
| 2015/0325943 | A1 | 11/2015 | Frey et al. |
| 2015/0340805 | A1 | 11/2015 | Jordan |
| 2016/0056585 | A1 | 2/2016 | Dunwoody et al. |
| 2016/0099527 | A1 | 4/2016 | Loveless et al. |
| 2016/0211627 | A1 | 7/2016 | Planard-Luong |
| 2016/0380380 | A1 | 12/2016 | Koepsell |
| 2017/0104280 | A1 | 4/2017 | Edmonds et al. |
| 2017/0141507 | A1 | 5/2017 | Tucker |
| 2017/0264049 | A1 | 9/2017 | Tiberghien et al. |
| 2017/0331207 | A1 | 11/2017 | Lappoehn |
| 2018/0054017 | A1 | 2/2018 | Watkins et al. |
| 2018/0069342 | A1 | 3/2018 | Kasar et al. |
| 2018/0138685 | A1 | 5/2018 | Sandell et al. |
| 2018/0212359 | A1 | 7/2018 | Wei |
| 2018/0223888 | A1 | 8/2018 | Nguyen |
| 2018/0323556 | A1 | 11/2018 | Storione et al. |
| 2019/0067859 | A1 | 2/2019 | Sugiura |
| 2019/0360847 | A1 | 11/2019 | Tanner et al. |
| 2021/0159633 | A1 | 5/2021 | Storione et al. |
| 2022/0409303 | A1 * | 12/2022 | Kadshai ..... B25J 19/0025 |

FOREIGN PATENT DOCUMENTS

| | | | |
|---|---|---|---|
| CN | 106299871 | | 1/2017 |
| CN | 205911563 | U | 1/2017 |
| CN | 106877088 | A | 6/2017 |
| CN | 106998009 | A | 8/2017 |
| CN | 206619765 | U | 11/2017 |
| DE | 37 22 196 | | 1/1989 |
| DE | 41 35 679 | | 5/1993 |
| EP | 0021864 | A1 | 1/1981 |
| EP | 1843440 | A1 | 10/2007 |
| EP | 1988607 | A2 | 11/2008 |
| EP | 2 144 336 | | 3/2011 |
| EP | 2 461 429 | | 6/2012 |
| EP | 2 533 374 | | 12/2012 |
| EP | 2 806 508 | | 11/2014 |
| FR | 1 354 923 | | 3/1964 |
| FR | 2 456 406 | | 12/1980 |
| FR | 2 690 569 | | 10/1993 |
| FR | 2930683 | A1 | 10/2009 |
| FR | 3 010 245 | | 3/2015 |
| JP | H02-052287 | U | 4/1990 |
| KR | 2013-0039691 | A | 4/2013 |
| KR | 10-1795298 | B1 | 11/2017 |
| RU | 2261505 | C1 | 9/2005 |
| RU | 148877 | U1 | 12/2014 |
| SU | 1693670 | A1 | 11/1991 |
| WO | 97/02630 | | 1/1997 |
| WO | 2005/053100 | A2 | 6/2005 |
| WO | 2006/060772 | A2 | 6/2006 |
| WO | 2011/118917 | A2 | 9/2011 |
| WO | 2012/112580 | | 8/2012 |
| WO | 2013/175720 | A1 | 11/2013 |
| WO | 2015/028953 | | 3/2015 |
| WO | 2017/030573 | A1 | 2/2017 |
| WO | 2017/072620 | | 5/2017 |
| WO | 2017/159155 | | 9/2017 |

OTHER PUBLICATIONS

Search Report dated Apr. 7, 2022, issued in Russian Federation Patent Application No. 2020134236/07(062844), 2 pages.

Office Action dated Apr. 8, 2022, issued in Russian Federation Patent Application No. 2020134236/07(062844), 5 pages.

International Search Report for PCT/IB2019/052822 dated Jun. 6, 2019, 6 pages.

Written Opinion of the ISA for PCT/IB2019/052822 dated June 4. 2019, 8 pages.

* cited by examiner

MULTIPOLAR CONNECTOR

CORRESPONDING APPLICATION

This application is the U.S. national phase of International Application No. PCT/IB2019/052822 filed Apr. 5, 2019 which designated the U.S. and claims priority to International Patent Application PCT/IB2018/052391 filed Apr. 6, 2018, the entire contents of each of which are hereby incorporated by reference.

FIELD OF THE INVENTION

The present invention relates to connectors, in particular multipolar electric connectors, used for example in the field of electrical wiring. For example, the connectors in question are used for/in fields of application necessitating both reliability and flexibility, such as applications of the wearable type, for example the clothing or equipment of people moving in difficult environments (workers, emergency service, soldiers and security forces, etc . . . ) or any other similar use.

PRIOR ART

In most cases, the use of a multipolar connector necessitates that the two principal components of the connector (for example a component containing male contacts, for example a plug, and a component containing female contacts, for example a socket) are connected with respect to each other according to a specific and predetermined angular orientation. This constraint may be achieved by particular shapes of the components allowing only a connection according to a predetermined relative position, or by other equivalent technical means (like asymmetrical constructions, interlocking components, etc.).

However, having to align one component with respect to the other one before connecting them is an inconvenience for the user. This inconvenience is particularly notable if the components of the connector cannot be seen by the user when the connection is made (for example due to a lack of light or in a position hidden from view), or when the connection must be made quickly.

There is therefore a need to be able to overcome this inconvenience.

The international application WO 2017/072620 describes a multipolar connector aimed at overcoming these problems, the content of this previous application being incorporated by reference in the present application.

The connector described in this previous application comprises a socket of substantially cylindrical shape and a plug, which may be connected to the socket in a removable or detachable manner, in which plug are arranged a plurality of contacts. The socket comprises a conductive surface in the form of a disk on or in which there is placed at least one conductive track forming at least one arc of circle whose center is substantially merged with the center of the conductive surface, said track being disposed moreover is such a way as to produce a mechanical electrical coupling with one of said contacts of the plug when the plug and the socket are connected.

In the particular configuration which comprises only one circular track, the center of the surface of the socket is a conductive disk, which is disposed in such a way as to form an electrical coupling with a contact of the plug disposed in the center thereof.

The described connector preferably comprises several circular conductive tracks which are disposed concentrically. In general, the number of tracks is equal to the number of contacts but in some embodiments their number may be different. This construction and its various embodiments are applicable to the connector according to the present invention.

GENERAL DESCRIPTION OF THE INVENTION

The purpose of the present invention is to provide improvements to the known connectors, and in particular to the connector described in WO 2017/072620, notably with regard to the fluid-tightness of said connector in order to allow its use in unfavorable environments (damp, dusty, freezing, etc.) among other things.

One embodiment of the present invention relates to a locking module having fluid-tightness so that it can guarantee the possibility of connection at temperatures greatly below 0° C. whilst preventing freezing and the presence of ice in the system. More generally, the fluid-tightness is also able to provide protection from unfavorable environments: dampness, dust, etc.

In embodiments, the invention relates to a module for a connector, the module comprising a ring comprising at least ogive shaped parts assembled in a flexible membrane, the ogive shaped parts and the membrane being covered by a locking spring. In the context of the present invention the notion "assembled" (as in "ogive shaped parts assembled in the membrane") must be understood in a wide sense according to which the two components (ogive shaped part and membrane) are combined. The assembly may be carried out in different ways, for example by overmolding of the membrane over the ogive shaped parts or by manual insertion. Other equivalent methods are of course possible.

The flexible membrane may have an annular shape, or another shape, for example oval or rectangular, which may depend, for example, on the shape of the connector or of the parts of the connector (for example the plug).

In embodiments, the ring may comprise three or more ogive shaped parts, said ogive shaped parts preferably being distributed symmetrically.

In embodiments, the flexible membrane is compressed by the locking spring and forms, by its deformation resulting from its compression by the spring, a sealing element of the ring.

In embodiments, the compression force of the spring is determined by movable parts of the spring.

In embodiments, the movable parts of the spring may be sized or shaped to calibrate the applied compression force.

In embodiments, the movable parts have a predetermined size, and/or shape and/or prestressing in order to obtain the desired compression force.

In embodiments, the invention relates to a plug or a socket for a connector comprising at least a module such as described in the present application.

In embodiments, the plug may be angled or not angled.

In embodiments, the invention relates to a connector comprising at least a module and/or a plug such as described in the present application.

In embodiments, the connector may comprise a socket onto which the plug is connected.

In embodiments, the plug may be connected such that it rotates freely around the socket.

In embodiments, the plug may be connected according to a limited number of orientations around the socket.

In embodiments, the plug comprises a plurality of contacts and the socket comprises a plurality of conductive tracks. The tracks are preferably of circular shape and disposed concentrically.

In embodiments, the number of tracks of the socket is equal to the number of contacts of the plug. In embodiments their number may be different.

In embodiments, the contacts may be on the socket and the tracks on the plug.

In embodiments, the connector according to the invention comprises a locking system making it possible to block the rotation of the plug with respect to the socket and/or to limit said rotation and/or to prevent the unplugging of the plug from the socket, for example below a certain traction force threshold.

In embodiments, the invention relates to an object comprising at least a socket such as described in the present applicion and combined with a plug such as described in the present application. The assembly forms an object connected by means of the connector formed by the socket and the plug. The object is for example a "wearable" object such as a vest or a harness or another piece of clothing.

DETAILED DESCRIPTION OF THE INVENTION

The invention will be better understood in the following description of different embodiments and technical features thereof, said embodiments being given as non-limiting examples.

In general, the connector according to the present invention is similar to the one described in the application WO 2017/072620 in that it comprises a socket and a plug, the plug being detachably connected to the socket as described in that previous application, incorporated by reference in the present application.

In an embodiment, the invention relates to a module 20 for locking a plug onto a socket 3 in a fluid-tight manner.

The locking module 20 for connecting a plug to a socket 3 is fluid-tight in order to guarantee the possility of connection at temperatures greatly below 0° C. preventing freezing and the presence of ice or of other undesirable elements in the system.

As illustrated in the figures, the module 20 notably comprises ogive shaped parts 21 (there are six of them in the version shown, although it is possible to imagine all possible variants with regard to the number of ogive shaped parts, but preferably there are at least three of them distributed symmetrically) assembled in a flexible membrane 22 (of annular shape in this example but it is possible to imagine a version in the form of a strip which would then be rolled in such a way as to form a cylinder/ring or another equivalent way of proceeding).

The flexible membrane 22 may be produced by any type of means (injection, stamping, punching, etc.) and from all types of synthetic materials able to withstand chemical agents for example or to withstand other stresses, and to produce the desired fluid-tightness according to the principles of the present invention.

The flexible membrane may also have a shape other than the annular shape shown by way of example. It can have an oval, square of other shape depending on the circumstances and on the shape of the parts of the connector.

The ogive shaped parts 21 may have the shape shown in the figures or another shape. For example, they can have the shape of a ball, an oval shape or any other equivalent shape.

Figure 1:
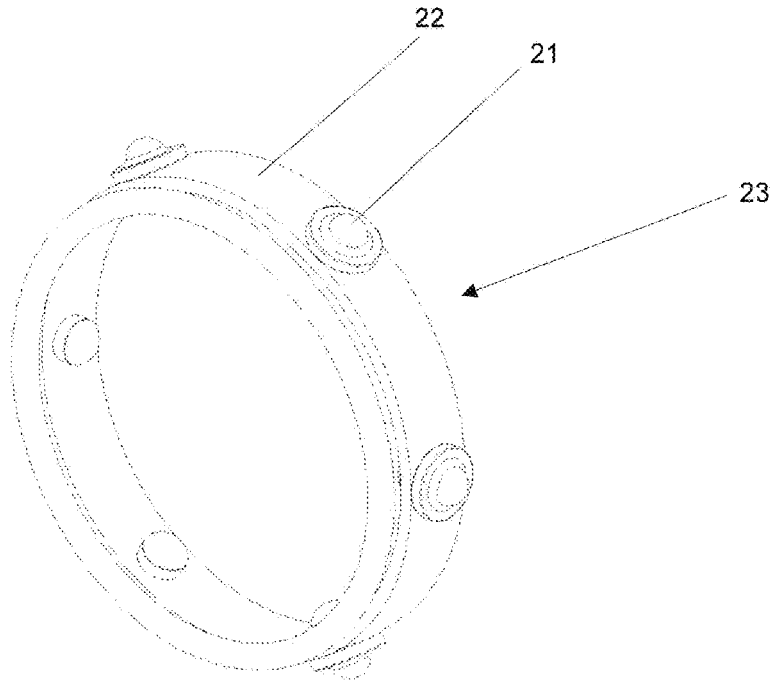
FIG. 1 illustrates a perspective view of a part of an embodiment of the invention.

The subassembly 23 (see FIG. 1) thus constituted is positioned on a ring 24 of the plug (see FIGS. 2 to 5).

The subassembly 23 mounted on the ring 24 is then assembled in a covering locking spring 25 which makes it possible to guarantee the bearing force on the subassembly 23. The locking spring 25 can be made of any appropriate material, for example metal or synthetic material. The spring preferably comprises a fixed part 26 and moving parts 27 which provide clearance to the ogive shaped parts 21 and thus allow the connection and disconnection of the ring 24 (respectively of the plug) from a socket 3 for example. The force of the connection between the plug and the socket is notably determined by the moving parts 27 which function like springs pressing on the ogive shaped parts 21. These moving parts 27 may be sized is such a way as to calibrate the force that they apply onto the ogive shaped parts and consequently the force necessary for the connection and disconnection of the plug and the socket 3.

For example, the moving parts 27 may be more or less long or more or less short, more of less thick, may have a special shape or cutout, or may be prestressed etc. in order to determine their bearing force. All of these parameters are adaptable according to the circumstances and the desired construction.

Thus, the dimensions and characteristics of the spring 25 (in particular of the moving parts 27) make it possible, on the one hand, to define the bearing force on the ogive shaped parts 21 and therefore the locking force of the fluid-tight locking module 20 and, on the other hand, the compression force of the spring 25 (this is of the moving parts 27) will also compress the flexible membrane 22 by the intermediary of the ogive shaped parts 21 and the deformation of the membrane 22 by compression will notably extend it in the direction perpendicular to that of the compression force which will have a beneficial consequence on the fluid-tightness of the ring 24. More precisely, the membrane 22 deforms in compression in the direction parallel to that of the compression force of the spring 25 and in expansion in the direction perpendicular to that of the compression force which produces the desired fluid-tightness around the ogive shaped parts 21 and in the ring 24.

Seals 30, 31, 32, of the O-ring type for example, may be disposed in appropriate places of the ring 24 in order to maintain fluid-tightness.

Figure 6:
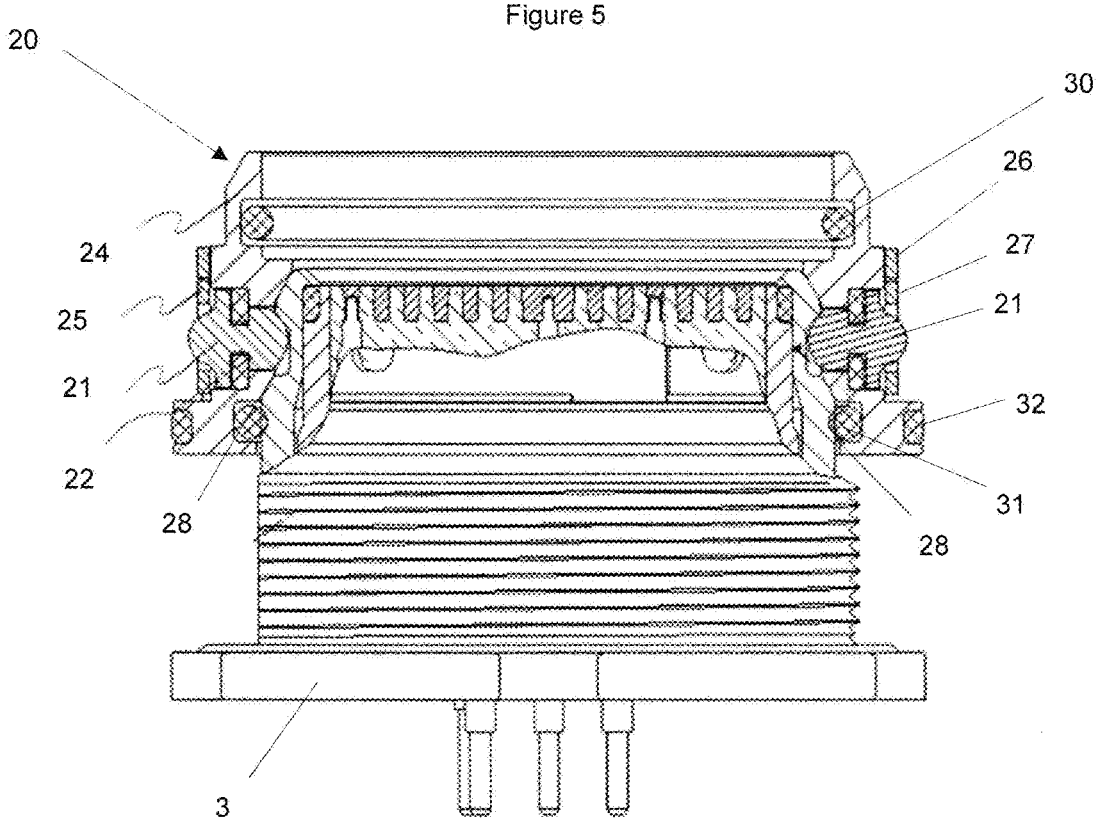
FIG. 6 illustrates a side view in partial cross-section of a module mounted on a plug connected to a socket according of an embodiment of the invention.

The assembly thus constituted can be connected to a counterpart, for example a socket 3, having a groove 28 whose geometry contributes to defining the locking force, said groove receiving the ogive shaped parts 21 as can be seen in FIG. 6.

Figure 7:
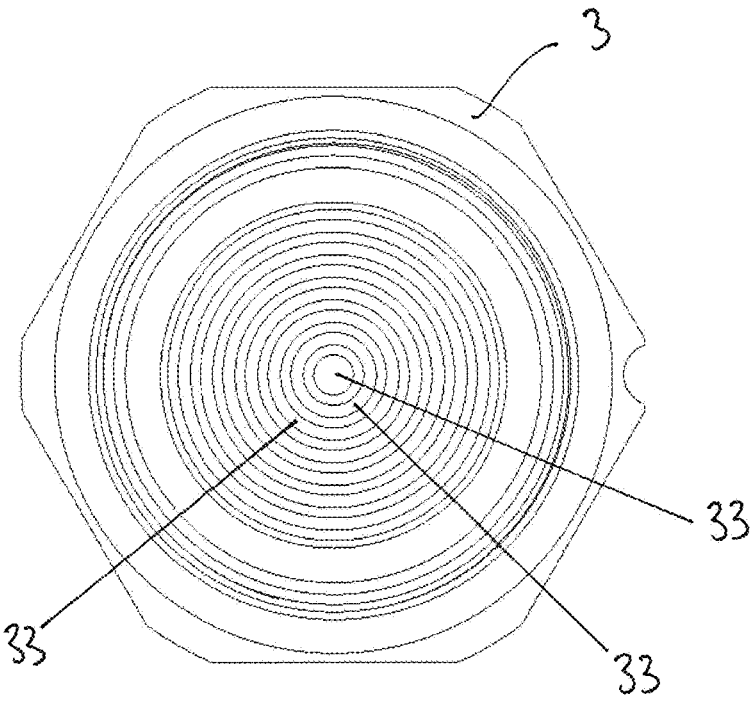
FIG. 7 illustrates a top view of a socket.

The fitted assembly of a module 20 on a socket 3 is shown by way of example in FIG. 6 and the module is typically a part of the plug which will be connected to the socket according to the principles described in WO 2017/072620. FIG. 7 shows an example of such a socket 3 seen from above with circular and concentric tracks 33.

According to the embodiments shown in the present application, the plug 2 comprises several contacts and the socket comprises several tracks 33, for example in a way that is similar to that described in WO 2017/072620.

Figure 8:
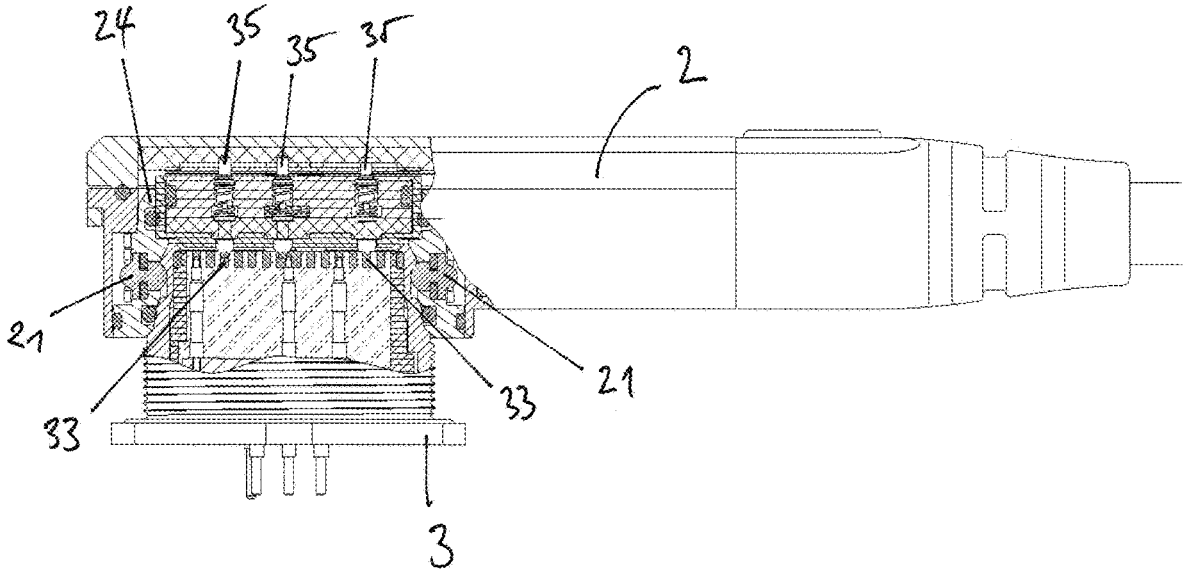
FIG. 8 illustrates an embodiment of a connector comprising a plug and a socket connected according to the present invention.

FIG. 8 shows a plug 2 and a socket 3 connected according to the principles of the present invention. The plug 2 notably comprises a module 20 such as described with reference to the preceding figures with its ring and its ogive shaped parts 21. The plug 2 also comprises contacts which are in contact with the tracks 33 of the socket, according to the principles of WO 2017/072620.

It goes without saying that the invention is not limited to this configuration. It also covers connectors comprising at least one contact.

Similarly, the dimensions of the connector according to the invention can be any whatsoever.

The connector according to the invention has the feature of not necessitating a prior orientation of the plug (for example a wired element) with respect to the socket 3 (for example on an equipment casing, or on a product like an item of clothing 4 or another product). This advantage results from the cylindrical/circular geometry of the socket and of its conductive face (see for example FIG. 1 of WO 2017/072620). Once connected, the relative rotation of the socket 3 and the plug 2 may be free or blocked by the intermediary of an appropriate system, for example of the bistable type to mention a non-limiting example, for example locking by lateral pressure and unlocking by axial pressure, a system of notches or again a manually actuated system. Locking between the plug 2 and the socket 3 can also be used in order to prevent the "unplugging" of the plug 2. An example of embodiment is the so-called "push-pull" system. The blocking system can also be used for a combined utilization, that is to say for simultaneously limiting or blocking a relative rotation and also for preventing an unplugging.

Figure 2:
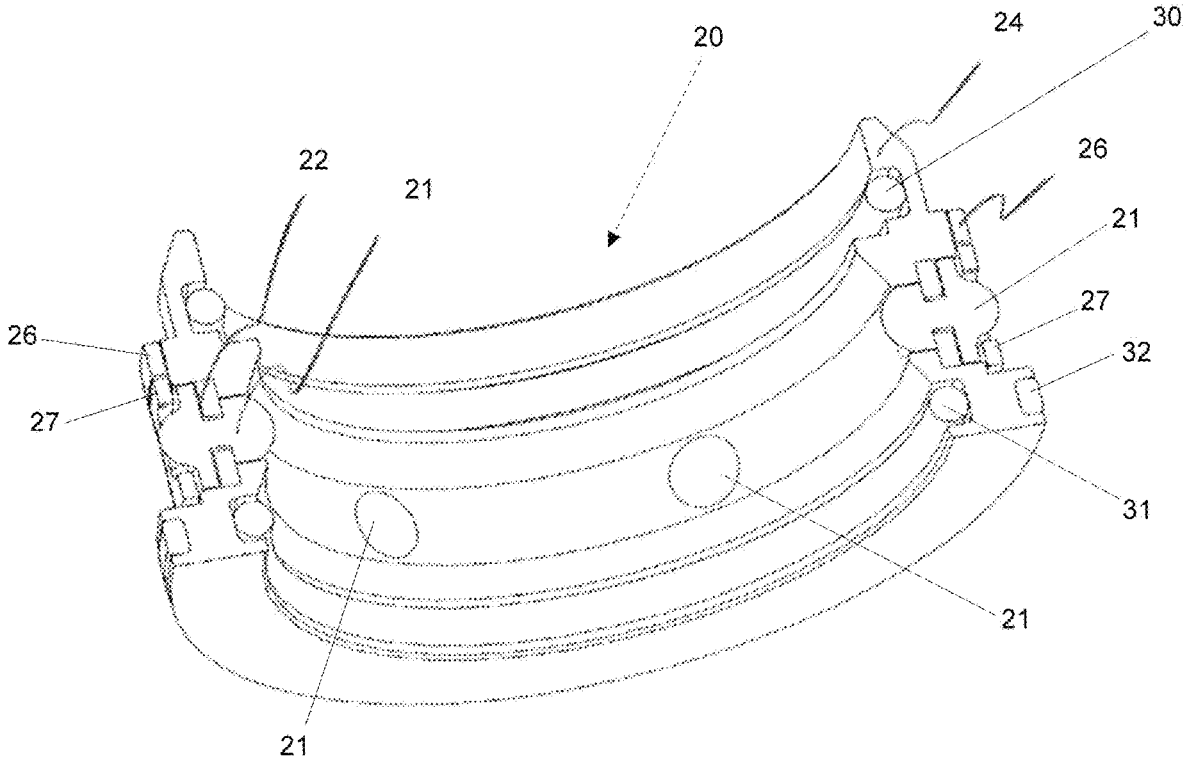
FIG. 2 illustrates a cross-sectional and perspective view from below of a locking module according to an embodiment.
Figure 3:
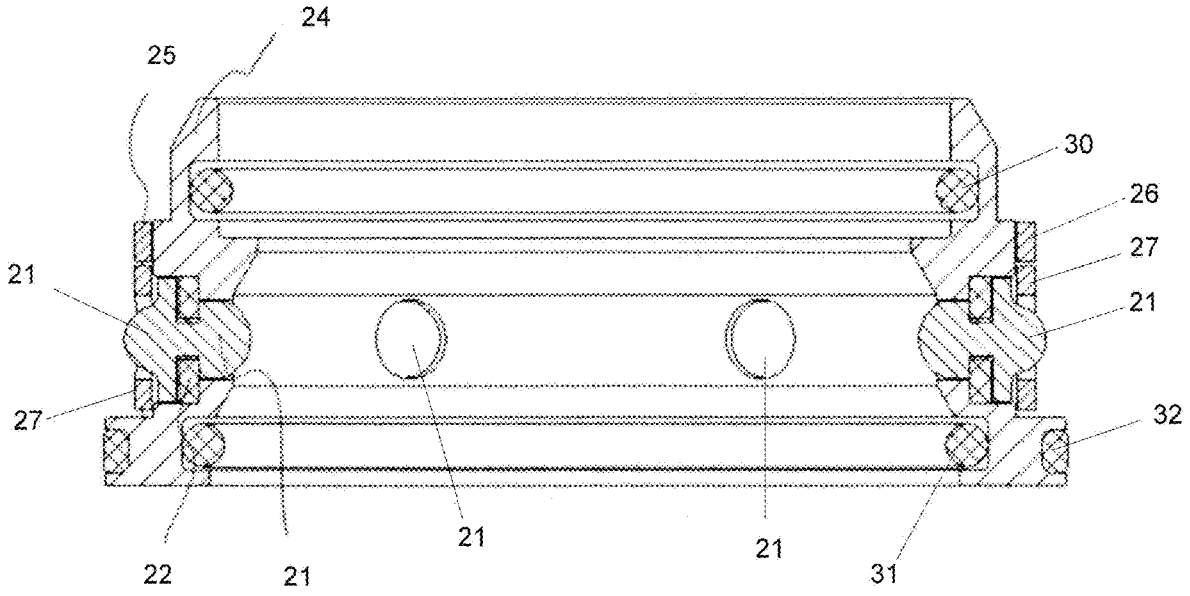
FIG. 3 illustrates a cross-sectional side view of a locking module according to an embodiment.
Figure 4:
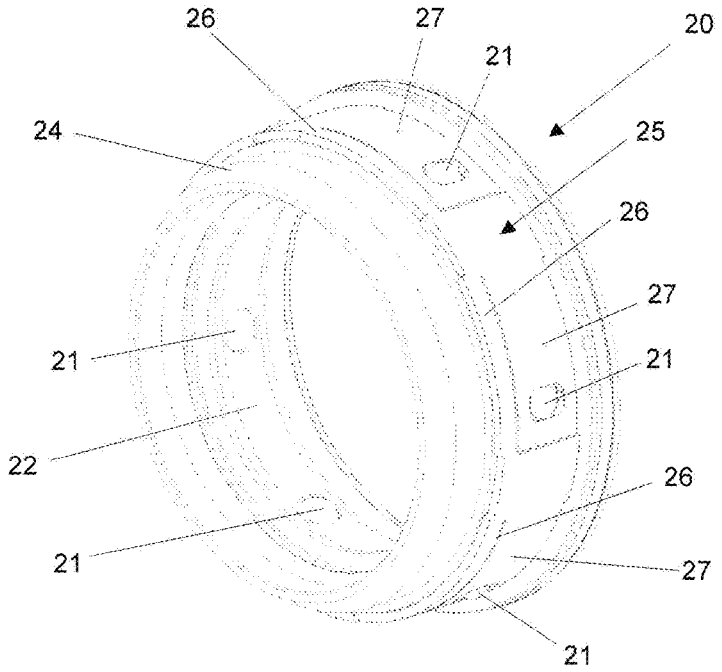
FIG. 4 illustrates a perspective rear view of a locking module according to an embodiment.
Figure 5:
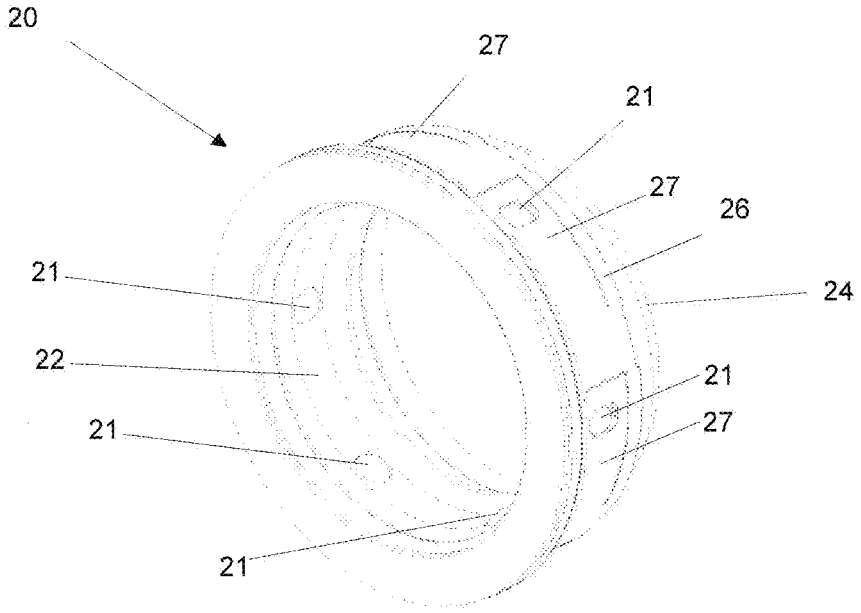
FIG. 5 illustrates a perspective front view of a locking module according to an embodiment.

An orientation may however be given and limit the possibilities of plugging in to a finite number of different angular positions (for example four positions separated by 90° or 12 positions separated by 30°) as described on FIG. 2 of WO 2017/072620.

Figure 10:
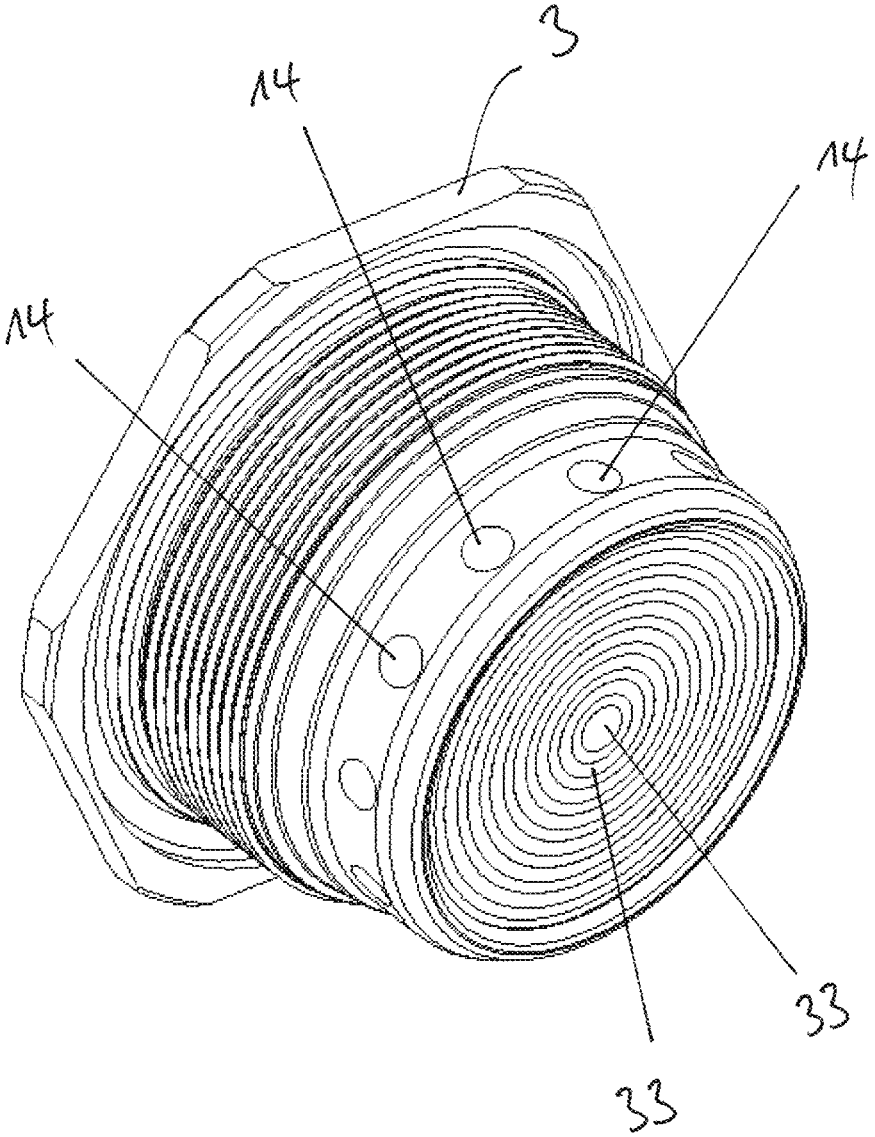
FIG. 10 illustrates an embodiment of a socket with locking means.

FIG. 10 illustrates a socket 3 with tracks 33 and an example of blocking means between the socket 3 and the plug 2. In this example, these means comprise housings 14 in which the ogive shaped parts or balls 21 of the plug 2 (see FIG. 8) may lodge in order to block or limit the relative rotation between the plug 2 and the socket 3 and/or to prevent an unplugging (for example below a certain traction force). The number of housings 14 may for example be a multiple of the number of ogive shaped parts 21.

Figure 9:
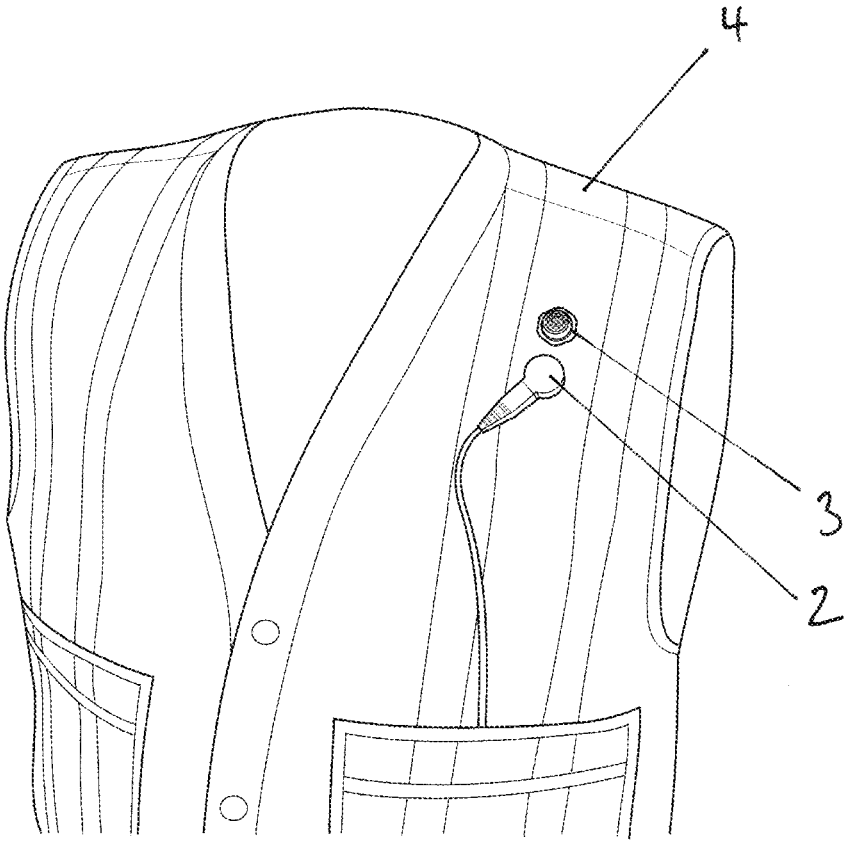
FIG. 9 illustrates an object comprising a connector according to an embodiment of the present invention.

FIG. 9 illustrates an example of use of a connector according to the present invention: in this non-limiting example, the socket 3 is fixed on a vest 4 and the plug 2 is ready to be connected to the socket 3 in order to get into the configuration shown in FIG. 8.

The invention is not of course limited to the illustrative and non-limiting embodiments and examples described in the present application. Variations are possible within the context of the protection conferred and claimed, notably by using equivalent means. The embodiments can also be combined with each other and technical features of one of the embodiments can be used in another embodiment.

For example, in embodiments, the construction of the plug and of the socket is reversed: that is to say the contacts 35 may be on the socket 3 and the tracks 33 on the plug 2. In such a case, the construction described in the present application is found again but is reversed, that is to say that elements of the plug 2 (notably shown in FIGS. 1 to 5) are placed on/in the socket 3 and elements of the socket 3 (notably the tracks 33, housings 14, FIG. 7) are placed on/in the plug 2 and the principles of the present invention such as described in this application do not change and apply in a corresponding manner to these embodiments.

Other variants are of course possible in the frame of the present invention.

The invention claimed is:

1. A module for a connector, the module comprising:
- a mounting ring;
- a flexible membrane having a circular shape operatively attached to the mounting ring;
- a plurality of ogive-shaped parts arranged to traverse the flexible membrane;
- a locking spring that at least partially covers the ogive-shaped parts and the flexible membrane, the locking spring configured to compress the flexible membrane to deform the flexible membrane to provide for fluid-tightness around the ogive-shaped parts and in the mounting ring.

2. The module according to claim 1, wherein the plurality of ogive-shaped parts include at least three ogive shaped parts, the ogive-shaped parts symmetrically distributed around the flexible membrane.

3. The module according to claim 1, wherein the locking spring includes a plurality of moving parts, the flexible membrane being compressed by the plurality of moving parts.

4. The module according to claim 3, wherein a compression force of the locking spring is determined by the plurality of moving parts.

5. The module according to claim 3, wherein the plurality of moving parts are configured to determine the compression force to the flexible membrane.

6. The module according to claim 3, wherein the plurality of moving parts have a predetermined size, shape and/or prestressing to obtain the compression force.

7. A connector part comprising at least a module according to claim 1.

8. The connector part according to claim 7, wherein the connector part includes a plug or a socket.

9. The connector part according to claim 7, wherein the connector part includes an angled plug.

10. A connector comprising a plug and a socket, the plug or the socket having a connector part as claims in claim 7.

11. The connector according to claim 10, wherein the plug and the socket are configured to allow for a rotation relative to each other.

12. The connector according to claim 10, wherein the plug is configured to be connected according to a limited number of orientations relative to the socket.

13. The connector according to claim 10, wherein one of either the plug or the socket includes a plurality of contacts and the other one includes a plurality of concentrically disposed circular conductive tracks.

14. The connector according to claim 10, further comprising:

a locking system configured to allow a rotation of the plug to be blocked or limited relative to the socket.

* * * * *